US005432043A

United States Patent [19]

Hayashi

[11] Patent Number: 5,432,043

[45] Date of Patent: Jul. 11, 1995

[54] PRODUCT OF DIFFUSION TRANSFER PHOTOGRAPHY WITH POLYESTER COATED SUPPORT

[75] Inventor: Hiroshi Hayashi, Kanagawa, Japan

[73] Assignee: Fuji Photo Film Co., Ltd., Kanagawa, Japan

[21] Appl. No.: 197,868

[22] Filed: Feb. 17, 1994

[30] Foreign Application Priority Data

Feb. 19, 1993 [JP] Japan ..... 5-030146

[51] Int. Cl.[6] ..... G03C 1/775; G03C 1/93; G03C 8/52

[52] U.S. Cl. ..... 430/220; 430/203; 430/227; 430/533; 430/538; 430/212

[58] Field of Search ..... 430/212, 220, 203, 538, 430/533, 227

[56] References Cited

U.S. PATENT DOCUMENTS

| | | | |
|---|---|---|---|
| 3,312,549 | 4/1967 | Salminen et al. | 430/212 |
| 3,607,345 | 9/1971 | Thomas et al. | 430/533 |
| 4,364,971 | 12/1982 | Sack et al. | 430/212 |
| 4,839,257 | 6/1989 | Nakamura et al. | 430/212 |
| 5,194,362 | 3/1993 | Nakabayashi et al. | 430/212 |
| 5,312,682 | 5/1994 | Nishikawa et al. | 430/538 |

FOREIGN PATENT DOCUMENTS

| | | | |
|---|---|---|---|
| 5-127309 | 5/1993 | Japan | 430/538 |

*Primary Examiner*—Richard L. Schilling
*Attorney, Agent, or Firm*—Sughrue, Mion, Zinn, Macpeak & Seas

[57] ABSTRACT

Disclosed is a product of diffusion transfer photography comprising (a) a light-sensitive element having at least a silver halide emulsion layer, (b) an image-receiving element having an image-receiving layer, (c) two supports, and (d) a processing element having an alkaline processing solution developed between the two supports, wherein one of the two supports is a reflective support coated with a composition obtained by mixing and dispersing a white pigment in a resin on at least the surface thereof on which the image-receiving layer is to be coated, wherein 50% by weight or more of the resin is polyester synthesized by the polycondensation or copolycondensation of a dicarboxylic acid with a diol.

5 Claims, No Drawings

PRODUCT OF DIFFUSION TRANSFER PHOTOGRAPHY WITH POLYESTER COATED SUPPORT

FIELD OF THE INVENTION

The present invention relates to diffusion transfer photography, and more particularly to a product of diffusion transfer photography having improved photographic properties and practical performances.

BACKGROUND OF THE INVENTION

Diffusion transfer photography is known in the art today and will not be further discussed hereinafter. For details, references can be made to A. Rott, E. Weyde, *Photographic Silver Halide Diffusion Processes,* (Focal Press, 1972); J. Sturge, V. Walworth, A. Shepp, *Imaging Processes and Materials: Neblete's Eighth Edition,* Chapter 6, Instant Photography and Related Reprographic Processes (Van Nostrand Reinhold, 1989); G. Haist, *Modern Photographic Processing,* Vol. 2, Chapter 8, Diffusion Transfer, (John Wiley and Sons, 1979); T. H. James, *The Theory of Photographic Process,* Fourth edition, Chapter 6, (Macmillan, 1977), etc.

In the diffusion transfer process, many kinds of photographic materials can be prepared. Among commercial photographic light-sensitive materials are color instant photographs (e.g., FI-800, FP100C, available from Fuji Photo Film Co., Ltd.) and black-and-white instant photographs (e.g., FP3000B, EP400B, available from Fuji Photo Film Co., Ltd.). Any of these photographs is characterized by a structure in which an alkaline processing composition, e.g., a high viscosity or low viscosity alkaline processing composition containing a developer, is developed between two supports so that a transfer image can be obtained.

If the thickness of the processing solution developed between the two supports is too great, the various elements swell too much, increasing the diffusion distance of image-forming substances and hence retarding the finish of image formation (impairing the instantaneity). Thus, an image which looks blur as a whole (not sharp) is given. On the contrary, the reduction in the thickness of the processing solution developed between the two supports is advantageous in that the time required for the formation of an image is reduced and a sharp image can be obtained. However, it is also disadvantageous in that the amount of a developing agent and other components supplied into the light-sensitive material runs short and unevenness of the support (unevenness caused by fiber grain in the case of paper support) causes nonuniformity in the supplied amount of the processing solution, resulting in uneven development that leads to unevenness in image. In order to overcome these difficulties, various approaches have been considered such as change in the kind of fiber in the paper support and calendering of the support. However, these approaches are not sufficient to produce an ultrahigh smoothness support having a smoothness as high as 0.5 $\mu$m or less on an industrial basis. In order to reduce the unevenness of image density due to the unevenness of the paper, the review of the light-sensitive element or image-receiving element may be sufficiently worth considering. However, this approach is not sufficient to overcome the foregoing difficulties without impairing various performances.

Further, JP-A-59-171159 (The term "JP-A" as used herein means an "unexamined published Japanese patent application") discloses an approach which comprises the use of a polyester film. This approach exerts a sufficient effect of eliminating unevenness. However, this approach cannot entirely substitute for the prior art because it leaves much to be desired, i.e., it lacks the texture inherent to conventional photographs (plane looking, touch), is easily scratched at corners and makes fingerprints prominent. This approach is further disadvantageous in that it adds to the production cost.

The present invention is intended to obtain a photographic product which provides a sharp image that is less subject to image unevenness While maintaining a texture inherent to conventional photographs.

EP0507489A1 discloses a support for photographic paper comprising a polyester and titanium oxide coated on at least emulsion side of a raw paper. However, as can be seen in the expression "on the surface on which an emulsion is to be coated", EP0507489A1 is intended for the conventional type of photographic light-sensitive materials (e.g., color paper) but doesn't suggest effects on and application to diffusion transfer photography, particularly peel apart type instant photographs comprising an image-receiving sheet on which no emulsion is coated.

Further, the foregoing instant photography is characterized in that it is free from a procedure for removing a waste developing agent and alkali (rinsing process) and thus involves a process for neutralizing a high activity processing solution by lowering the pH thereof at the completion of development to give a low activity processing solution. These photographic materials need to be so hydrophobic that they are impermeable to an alkaline solution at the initial stage of processing. To this end, the foregoing instant photography mostly involves a production process for coating a nonaqueous solution. The coating in the form of nonaqueous solution can be hardly fixed after coated, possibly impairing the uniformity of the film. In order to overcome this difficulty, the coating is usually dried at a temperature as high as 80° C. to 110° C. in the art. However, in the case of a paper support comprising a raw paper of common use laminated with a polyolefinic resin (in most cases, polyethylene or polypropylene is used), which can easily soften, a slight amount of bubbles entrained in the raw paper or polyolefinic resin expand with the rise in the temperature and then penetrate or burst in the softened polyolefinic resin. This paper support is also disadvantageous in that the dimensional stability thereof is impaired by the shrinkage of the resin at a high temperature. In order to cope with these problems, the lowering of the drying temperature may be considered. However, this approach requires a longer drying zone. Further, the coating solution may comprise a dispersion of latex or the like so that the latex is fused to the paper during the drying process to form a continuous film. This approach is often advantageous in performance and cost (due to the absence of organic solvents). However, it has been keenly desired to make the resin laminate dryable at high temperatures without causing any problem to form a better continuous film.

SUMMARY OF THE INVENTION

It is therefore an object of the present invention to provide a product of diffusion transfer photography which is less subject to image unevenness in diffusion transfer process and exhibits an excellent production stability given by improved heat resistance during the production process.

This and other objects of the present invention will become more apparent from the following detailed description and examples.

This and other objects of the present invention are accomplished with the following product of diffusion transfer photography (1):

(1) a product of diffusion transfer photography comprising (a) a light-sensitive element having at least a silver halide emulsion layer, (b) an image-receiving element having an image-receiving layer, (c) two supports, and (d) a processing element having an alkaline processing solution developed between the two supports, wherein one of the two supports is a reflective support coated with a composition obtained by mixing and dispersing a white pigment in a resin on at least the surface of the support on which the image-receiving layer is to be coated, wherein 50% by weight or more of the resin is polyester synthesized by the Polycondensation or copolycondensation of a dicarboxylic acid with a diol.

DETAILED DESCRIPTION OF THE INVENTION

The present invention will be further described hereinafter.

The following products of diffusion transfer photography (2) to (8) in addition to (1) defined above are more preferred:

(2) the product of diffusion transfer photography as defined in (1), wherein the polyester to be incorporated in the reflective support is polyester comprising polyethylene terephthalate as a main component;

(3) the product of diffusion transfer photography as defined in (1), wherein the reflective support is coated with (a) a composition obtained by mixing and dispersing a white pigment in polyester synthesized by the polycondensation of a dicarboxylic acid with a diol on at least the surface of the support on which the image-receiving layer is to be coated, wherein the dicarboxylic acid component is a 9:1 to 2:8 mixture by mole of terephthalic acid and isophthalic acid, and (b) a resin or a resin composition obtained by mixing and dispersing a powder or the like in the resin on the other surface of the support;

(4) the product of diffusion transfer photography as defined in (1), wherein the reflective support is coated with (a) a composition obtained by mixing and dispersing a white pigment in polyester synthesized by the polycondensation of a dicarboxylic acid with a diol on at least the surface of the support on which the image-receiving layer is to be coated, wherein the dicarboxylic acid component is a 9:1 to 2:8 mixture by mole of terephthalic acid and naphthalenedicarboxylic acid, and (b) a resin or a composition obtained by mixing and dispersing a powder or the like in the resin on the other surface of the support;

(5) the product of diffusion transfer photography as defined in any one of (1), (3) and (4), wherein the diol is ethylene glycol;

(6) the product of diffusion transfer photography as defined in any one of (1) to (5), wherein the white pigment to be incorporated in the reflective support is titanium oxide and the weight proportion of titanium oxide to the resin mainly comprising polyester (titanium oxide/resin ratio) is from 5/95 to 50/50;

(7) the product of diffusion transfer photography as defined in any one of (1) to (6), which is arranged such that the image-receiving element and the light-sensitive element are separated from each other after the formation of an image via exposure and development procedures to make the image visible from the image-receiving layer side of the reflective support; and (8) the product of diffusion transfer photography as defined in any one of (1) to (6), which is arranged such that (a) the image-receiving element and the light-sensitive element are coated on separate supports, (b) the surface of the light-sensitive element and the surface of the image-receiving element are kept separated from each other before exposure and brought into contact with each other during development after exposure, and (c) the image-receiving element is separated from the light-sensitive element after the formation of an image to make the image visible from the image-receiving layer side of the reflective support.

The reflective .support according to the present invention needs to be one obtained by coating a substrate such as raw paper with a composition prepared by mixing and dispersing a white pigment in a resin comprising polyester in amount of 50% by weight or more on at least the surface thereof on which an image-receiving layer is to be coated.

The foregoing polyester is preferably one comprising polyethylene terephthalate as a main component.

Further, the foregoing polyester is preferably one synthesized by the polycondensation of a dicarboxylic acid with a diol. Preferred examples of such a dicarboxylic acid include terephthalic acid, isophthalic acid, and naphthalenedicarboxylic acid. Preferred examples of the diol include ethylene glycol, butylene glycol, neopentyl glycol, triethylene glycol, butanediol, hexylene glycol, bisphenol A-ethylene oxide adduct, (2,2-bis(4-(2-hydroxyethyloxy)phenyl) propane, and 1,4-dihydroxymethylcyclohexane.

In the present invention, various polyesters obtained by the (co)polycondensation of these dicarboxylic acids, singly or in admixture, with these diols, singly or in admixture, can be used. In particular, at least one of these dicarboxylic acids is preferably terephthalic acid. Alternatively, as the dicarboxylic acid component there may be preferably used (a) a 9:1 to 2:8 mixture by mole, preferably a 9:1 to 3:7 mixture by mole, and more preferably a 9:1 to 4:6 mixture by mole, of terephthalic acid and isophthalic acid or (b) a 9:1 to 2:8 mixture by mole, preferably a 9:1 to 3:7 mixture by mole, and more preferably a 9:1 to 4:6 mixture by mole, of terephthalic acid and naphthalenedicarboxylic acid. As the diol there may be preferably used ethylene glycol or a diol mixture containing ethylene glycol. The molecular weight of such a polymer is preferably from 30,000 to 50,000.

Further, a plurality of these polyesters having different compositions may be preferably used in admixture. Moreover, a mixture of these polyesters with other resins may be preferably used. The other resins to be mixed in these polyesters can be selected from the resins capable of being extruded at a temperature of 270° to 350° C., such as polyolefins (e.g., polyethylene, polypropylene), polyethers (e.g., polyethylene glycol, polyoxymethylene, polyoxypropylene), polyester polyurethane, polyether polyurethane, polycarbonate and polystyrene. These resins to be blended may be used, singly or in combination. For example, 90% by weight of a polyethylene terephthalate may be mixed with 6% by weight of a polyethylene and 4% by weight of a polypropylene. The mixing proportion of polyester with other resins varies with the kind of the resins to be blended. If the kind of the resins to be blended is polyolefins, the mixing proportion of polyester/other resins is preferably from 100/0 to 80/20 by weight, preferably from 100/0 to 90/10 by weight. If the mixing proportion of the other resins exceeds 20% by weight, the physical properties of the resin mixture drastically deteriorates. If the kind of the resins to be blended is other than polyolefin, the mixing proportion of polyester-/other resins may be from 100/0 to 50/50 by weight, preferably from 100/0 to 75/25 by weight. If the proportion of polyester falls below 50% by weight, the effects of the present invention cannot be fully exerted.

Examples of the white pigment to be mixed and dispersed in the polyester in the reflective support according to the present invention include inorganic pigments such as titanium oxide (e.g., titanium dioxide), barium sulfate, lithopone, aluminum oxide, calcium carbonate, silicon oxide, antimony trioxide, titanium phosphate, zinc oxide, white lead and zirconiumoxide, and finely divided powder of organic compounds such as polystyrene and styrene-divinylbenzene copolymer.

Among these pigments, titanium dioxide is particularly useful. Titanium dioxide may be either rutile type or anatase type or may be prepared by either sulfate process or chloride process. Examples of trade name of titanium dioxide employable in the present invention include KA-10 and KA-20 available from Titan Kogyo K.K. and A-220, R-930 and CR-50 available from Ishihara Sangyo Kaisha, Ltd.

The average grain diameter of the white pigment to be used in the present invention is preferably from 0.1 to 0.8 μm. If this value falls below 0.1 μm, it is difficult to uniformly mix and disperse the white pigment in the resin. On the contrary, if this value exceeds 0.8 μm, it is made impossible to provide sufficient whiteness and there are formed protrusions on the coated surface, adversely affecting the image quality.

The mixing proportion of the foregoing resin mainly comprising polyester to the white pigment (resin/white pigment) is generally from 98/2 to 30/70, preferably from 95/5 to 50/50, and more preferably from 90/10 to 60/40. If the content of the white pigment falls below 2% by weight, its contribution to whiteness is insufficient. On the contrary, if the content of the white pigment exceeds 70% by weight, the smoothness of the surface of the resulting support for photographic paper is insufficient, making it impossible to provide a support for photographic paper having an excellent gloss.

The mixture of the foregoing resin and white pigment is then kneaded into the resin with a dispersing agent such as metal salt of higher aliphatic acid, ethyl of higher aliphatic acid, amide of higher aliphatic acid and higher aliphatic acid by means of a kneading machine such as two-roll mill, three-roll mill, kneader and Banbury mixer. The resin layer may comprise an oxidation inhibitor incorporated therein. The content of such an oxidation inhibitor is preferably from 50 to 1,000 ppm based on the weight of resin.

The thickness of the resin/white pigment composition coated on the surface of the raw paper as reflective support on which an image-receiving layer is to be coated is generally from 5 to 100 μm, preferably from 5 to 80 μm, and more preferably from 10 to 50 μm. If the thickness exceeds 100 μm, it causes troubles on physical properties such as stressed fragility that leads to cracking. On the contrary, if the thickness falls below 5 μm, the waterproofness as original purpose of the coating is impaired. Further, whiteness and surface smoothness cannot be satisfied at the same time. Moreover, from the physical standpoint of view, the resulting support is too soft.

Examples of the resin coated on the surface on which the image-receiving layer is not coated include resins formed from polyolefin or the polyester according to the present invention. In order to keep the curl balance of the completed pictures, it is preferable that the resin has a similar humidity dependency and a similar thickness to the resin on which the image-receiving layer is coated.

Further, in order to raise purity whiteness, to add light imperviousness and to improve sliding property, various powders may be uniformly mixed with and dispersed in the resin. Examples of the powders include carbon black, titanium oxide, calcium carbonate and silicon dioxide.

The thickness of the resin or powder-containing resin composition coated on the surface on which the image-receiving layer is not coated is preferably from 5 to 100 μm, more preferably from 10 to 50 μm. If the thickness exceeds 100 μm, it causes troubles on physical properties such as stressed fragility that leads to cracking. On the contrary, if the thickness falls below 5 μm, the waterproofness as original purpose of the coating is impaired. Further, whiteness and surface smoothness cannot be satisfied at the same time. Moreover, from the physical standpoint of view, the resulting support is too soft.

The coating of the coating composition on the surface of the raw paper on which an image-receiving layer is to be coated and on the other surface may be effected by, e.g., melt-extrusion lamination process or the like.

The raw paper employable as reflective support according to the present invention can be selected from the group consisting of materials which are commonly used as photographic papers. Examples of such materials include natural pulp selected from the group consisting of needleleaf tree pulp and broadleaf tree pulp or synthetic pulp optionally comprising a filler (e.g., clay, talc, calcium carbonate, urea resin powder), a sizing agent (e.g., rosin, alkyl ketene dimer, higher aliphatic acid, epoxylated aliphatic amide, paraffin wax, alkenylsuccinic acid), a paper strength improver (e.g., starch, polyamide polyamine epichlorohydrin, polyacrylamide) and a fixing agent (e.g., sulfuric band, cationic polymer) incorporated therein.

The kind and thickness of the raw paper as substrate is not specifically limited. The weight of the raw paper is preferably from 50 g/m$^2$ to 250 g/m$^2$. The raw paper is preferably subjected to surface treatment such as machine calendering and supercalendering under heating or pressure for the purpose of obtaining smoothness and flatness.

Prior to the coating of the foregoing polyester/white pigment mixture composition on the raw paper, the surface of the raw paper is preferably subjected to pretreatment such as corona discharge, flame treatment and undercoating.

A polyester such as polyethylene terephthalate may exhibit a smaller adhesivity to the photographic emulsion than polyethylene. Therefore, if such a polyester is used, the polyester layer formed on the raw paper by melt-extrusion lamination process is preferably subjected to corona discharge followed by the coating of a hydrophilic colloidal layer.

Further, an undercoating solution containing a compound represented by the following formula [U] is preferably coated on the surface of a thermoplastic resin containing a polyester as a main component in the form of a thermoplastic resin:

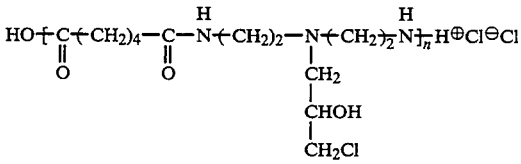

[U]

wherein n represents an integer 1 to 7.

The coated amount of the compound represented by formula [U] is preferably 0.1 mg/m$^2$ or more, more preferably 1 mg/m$^2$ or more, and most preferably 3 mg/m$^2$ or more. The more this value is, the greater is the adhesivity. If this compound is used excessively, it is disadvantageous in production cost. Accordingly, the upper limit of the coated amount is preferably 100 mg/m$^2$, more preferably 20 mg/m$^2$.

In order to improve the coatability of the undercoating solution on the surface of the resin, an alcohols such as methanol are preferably incorporated therein. The proportion of such alcohols to be incorporated is preferably 20% by weight or more, more preferably 40% by weight or more, and most preferably 60% by weight or more. The upper limit of the protection of such alcohols is not particularly limited, however, preferred one is 90% by weight. Further, the undercoating solution preferably comprises various surface active agents such as anionic, cationic, amphoteric, nonionic, carbon fluoride and organic silicon surface active agents to further improve its coatability.

In order to obtain an excellent undercoated surface, a water-soluble high molecular compound such as gelatin is preferably incorporated in the undercoating solution.

From the standpoint of stability of the compound represented by formula [U], the pH of the undercoating solution is preferably from 4 to 11, more preferably from 5 to 10.

Prior to the coating of the undercoating solution, the thermoplastic resin is preferably subjected to surface treatment. Examples of such a surface treatment include corona discharge, flame treatment, and plasma treatment.

The coating of the undercoating solution can be accomplished by any known coating process such as gravure coating, bar coating, dip coating, air knife coating, curtain coating, roller coating, doctor coating and extrusion coating.

The drying temperature of the coating is preferably from 30° C. to 100° C., more preferably from 50° C. to 100° C., and most preferably from 70° C. to 100° C. The upper limit of the drying temperature is determined by the heat resistance of the resin. The lower limit of the drying temperature is determined by the production efficiency.

The surface roughness as one of important characteristics of the reflective support according to the present invention will be discussed hereinafter. As a measure of the surface roughness there may be used central line average surface roughness. The central line average surface roughness is defined as follows. In some detail, a portion having an area of SM is extracted from the central part of a roughened curved surface. Rectangular coordinate axis X and Y are established on the central line on the extracted portion. The axis established crossing the central line is Z axis. Then, the value given by the following equation is defined as central line average surface roughness (Ra) in μm.

$$Ra = \frac{1}{SM}\int_0^{L_X}\int_0^{L_Y} |f(X \cdot Y)|\, dX \cdot dY$$

wherein $L_X L_Y = SM$ $$Z = f(X \cdot Y)$$

The central line average surface roughness and the height of protrusion from the central line can be determined by observing the area of 5 mm$^2$ with a diamond needle having a diameter of 4 μm by means of a three-dimensional surface roughness meter (SE-30H) available from Kosaka Kenkyusho K.K. at a cutoff value of 0.8 mm, a horizontal magnification power of 20 and a vertical magnification power of 2,000. The moving speed of the measuring needle is preferably about 0.5 mm/sec.

The reflective support according to the present invention preferably exhibits a value of 0.15 μm or less, more preferably 0.10 μm as determined by the foregoing measurement process.

The support other than the reflective support may be transparent or opaque. Preferred is a support which dose not show remarkable dimensional unstablity in processing. Examples of the support include the support which are used in the general photographic materials, such as cellulose acetate films, polystyrene films, polyethylene terephthalate films, polycarbonate films, baryta papers, and papers laminated by waterproof polymer (e.g., polyethylene) on the surface thereof.

As the layer structure of the photographic product which exerts the effects of the present invention there can be advantageously used the following:

First layer structure relates to a so-called peel apart type photograph commercially available as FP3000B or 100C from Fuji Photo Film Co., Ltd. This photographic product has a layer structure comprising a light-sensitive element on one support and an image-receiving element on the other support (reflective support). In this system, an image-forming substance produced by the development of the light-sensitive element diffuses into an image-receiving layer in the image-receiving element. After development, the image-receiving element is separated from the light-sensitive element to make the developed image visible. Second layer structure relates to a photographic product comprising a reflective support having an image-receiving element, one or more peelable layers and a light-sensitive element coated thereon in this order and the other support free of coating or having an auxiliary layer such as neutralizing layer or neutralization timing layer alone coated thereon. In this useful embodiment, after development, the image-receiving element is peeled off the system at the peelable layer to make the developed image visible.

In the photographic product according to the present invention, the drying temperature at the coating procedure as one of the production procedures is preferably 80° C. or higher. More preferably, the photographic product of the present invention has at least one drying procedure of 80° C. or higher in coating the image-receiving layer or the image-receiving element. The upper limit of the drying temperature is determined by the kind of the materials used and the drying time as well as economic effects and is normally 130° C. or lower, more preferably from 90° C. to 120° C.

The members employable in the product of diffusion transfer photography according to the present invention will be discussed hereinafter.

The neutralizing layer employable in the present invention may preferably comprise a film-forming acidic polymer. Any such an acidic polymer may be used. Examples of such an acidic polymer include monobutylester of copolymer of maleic anhydride and ethylene, monobutylester of copolymer of maleic anhydride and methylvinyl ether, monoethylester, monopropylester, monopentylester or monohexylester of copolymer of maleic anhydride and ethylene, monoethylester, monopropylester, monobenzylester or monohexylester of copolymer of maleic anhydride and methyl vinyl ether, polyacrylic acid, polymethacrylic acid, copolymer of various proportions of acrylic acid and methacrylic acid, and copolymer of various proportions of acrylic acid or methacrylic acid such as acrylic esters, methacrylic esters, vinylethers, acrylamides and methacrylamides, preferably having an acrylic or methacrylic acid content of 50 to 90 mol %. Such an acidic polymer may be used in admixture with a polymer such as polyvinyl alcohol, polyacrylamide, gelatin and acetyl cellulose as described in Research Disclosure No. 15162.

For the neutralizing layer, references can be made to U.S. Pat. Nos. 3,362,819, 3,765,885, and 3,819,371, and French Patent 2,290,699. In particular, polyacrylic acids, acrylic acid-butyl acrylic acid copolymers, maleic anhydride-methyl vinyl ether copolymers, etc. may be effectively used.

These acidic polymers are effectively used in combination with polyvinyl alcohol or acetyl cellulose as described in JP-A-61-15141. In particular, the combined use of polyacrylic acid and polyvinyl alcohol or the combined use of maleic anhydride-methyl vinyl ether copolymer and acetyl cellulose is desirable.

In the implementation of the present invention, a neutralization timing layer is preferably provided. This neutralization timing layer comprises gelatin, polyvinyl alcohol, polyacrylamide, partially hydrolyzed polyvinyl acetate, β-hydroxyethyl methacrylate-ethyl acrylate copolymer and acetyl cellulose as main components, and the compounds as described in U.S. Pat. Nos. 3,455,686, 3,421,893, 3,785,815, 3,847,615, and 4,009,030, and JP-A-52-14415. Further, the foregoing neutralization timing layer may be used in combination with a polymer layer which exhibits a great temperature dependence of permeation of an alkaline processing solution as described in U.S. Pat. Nos. 4,056,394, and 4,061,496, and JP-A-53-72622, and 54-78130.

Further, the neutralization timing layer employable in the present invention may comprise a product of polymerization of monomers capable of undergoing β-elimination. Examples of such a polymerization product include those described in JP-A-60-19137, U.S. Pat. Nos. 4,297,431, 4,288,523, 4,201,587, and 4,229,516, JP-A-55-121438, JP-A-56-166212, JP-A-55-41490, JP-A-55-54341, JP-A-56-102852, JP-A-57-141644, JP-A-57-173834, JP-A-57-179841, West German Patent Application Publication No. (OLS) 2,910,271, European Patent Application Publication No. EP31957A1, and Research Disclosure No. 18452.

If the photographic product according to the present invention is used for color photography, the image-receiving layer is preferably a hydrophilic colloidal layer containing a polymer mordant.

The polymer mordant as used herein is a polymer containing a secondary or tertiary amino group, a polymer containing a nitrogen-containing heterocyclic portion, a polymer containing these quaternary cationic groups or the like having a molecular weight of 5,000 to 200,000, preferably 10,000 to 50,000.

Among these mordants, those which can hardly migrate from the mordant layer to other layers are preferably used. Examples of such mordants include those which undergo crosslinking reaction with a matrix such as gelatin, water-insoluble mordants, and latex dispersion (or aqueous sol) type mordants. As mordants which can be preferably used in the present invention there can be used those described in Research Disclosure No. 15162.

The mordant layer may comprise a discoloration inhibitor or ultraviolet absorbent incorporated therein to inhibit the discoloration of dyes.

If the photographic product according to the present invention is used for color photography, a dye-providing compound is used. As such a dye-providing compound there may be used any compound which imagewise forms a diffusive dye or its precursor as a result of development. For example, nondiffusive coupler which releases a dye developing agent or diffusive dye may be used. A dye-releasing redox compound is preferably used. Either a negative working or positive working dye-releasing redox compound may be used depending on the type of silver halide photographic emulsion to be used in combination therewith.

The photographic product according to the present invention can be used for silver salt diffusion transfer process. Image-receiving elements useful in the silver salt diffusion transfer process are well known. Particularly useful among these image-receiving elements are those disclosed in JP-A-60-41041, JP-A-60-43658, JP-A-60-17440, and JP-A-60-37553.

Specific examples of silver precipitation nucleus include metal such as palladium, silver, platinum and cobalt, and sulfide thereof.

The processing solution contains a base such as sodium hydroxide, potassiumhydroxide, sodiumcarbonate and sodium phosphate and thus exhibits an alkaline strength of pH 9 or more, preferably pH 11.5 or more. The processing solution may contain an oxidation inhibitor such as sodium sulfite, ascorbate and piperidinohexose reductone. Alternatively, the processing solution may contain a silver ion concentration adjustor such as potassium bromide. Further, the processing solution may comprise a viscosity-increasing compound such as hydroxyethyl cellulose and sodium carboxymethyl cellulose.

The alkaline processing solution is preferably contained in a pressure-rupturable vessel.

In some detail, an arrangement is preferably used such that when the photographic product is withdrawn from a camera after exposure to the light-sensitive element, the lamination of the light-sensitive element and the image-receiving element passes through a gap between a pair of juxtaposed pressing members so that pressure-rupturable vessels disposed between two supports are destroyed, releasing a processing solution which is then spread over the entire surface of the light-sensitive element to develop exposed silver halide grains, and the resulting image is then transferred to the image-receiving element.

The present invention will be further described in the following examples, but the present invention should not be construed as being limited thereto.

EXAMPLES

EXAMPLE 1

Preparation of reflective support

Onto a 180-μm thick raw paper was melt-extruded a mixture composition of a polyethylene (intrinsic viscosity: 6.5) or polyethylene synthesized by the polycondensation of a dicarboxylic acid composition as set forth in Table 1 and ethylene glycol and titanium oxide (KA-10 available from Titan Kogyo K.K.) at a temperature of 300° C. to form a laminate layer having a thickness of 30 μm thereon. Onto the other surface of the raw paper was melt-extruded a calcium carbonate-containing resin composition at a temperature of 300° C. to form a laminate layer having a thickness of 30 μm thereon.

TABLE 1

| No. | Resin (dicarboxylic acid component in polyester) | $TiO_2$ content (wt %) |
|---|---|---|
| 1 | Polyester (terephthalic acid: 100) | 20 |
| 2 | Polyester (terephthalic acid/ isophthalic acid: 90/10 by mole) | 20 |
| 3 | Polyester (terephthalic acid/ isophthalic acid: 90/10 by mole) | 20 |
| 4 | Polyester (terephthalic acid/ naphthalenedicarboxylic acid: 90/10 by mole) | 20 |
| 5 | Polyester (terephthalic acid/ naphthalenedicarboxylic acid: 50/50 by mole) | 20 |
| 6 | Polyethylene | 15 |

Note)
Nos. 1 to 5 are according to the present invention while No. 6 is comparative.

Preparation of light-sensitive material:

Onto the support thus obtained were coated the following layers to prepare an image-receiving sheet (Image-receiving sheet No. 101).

Image-receiving sheet:

Backing layer:

(a) Light shielding layer containing 4.0 g/m² of carbon black and 2.0 g/m² of gelatin;

(b) White layer containing 8.0 g/m² of titanium oxide and 1.0 g/m² of gelatin;

(c) Protective layer containing 0.6 g/m² of gelatin.

Components (a) to (c) were coated in this order.

Image-receiving layer:

(1) Neutralizing layer containing 4 g/m² of polyacrylic acid (average molecular weight: 30,000) and 4 g/m² of polyvinyl alcohol (average molecular weight: 5,000; percent saponification: 88%);

(2) Neutralization timing layer containing a cellulose acetate having a percent acetylation of 51.3% (amount of acetic acid released by hydrolyzation: 0.513 g per 1 g of specimen) and a 1:1 (molar ratio) copolymer of styrene and maleic anhydride having an average molecular weight of about 10,000 in a proportion of 95:5 in an amount of 4.5 g/m²;

(3) Layer containing a 6:4 (solid content ratio) blend of a polymer latex obtained by emulsion polymerization of styrene, butyl acrylate, acrylic acid and N-methylolacrylamide in a proportion of 49.7/42.3/4/4 and a polymer latex obtained by emulsion polymerization of methyl methacrylate, acrylic acid and N-methylolacrylamide in a proportion of 93/3/4 in an amount of 1.6 g/m² as calculated in terms of solid content;

(4) Image-receiving layer obtained by coating 3.0 g/m² of the following polymer and 3.0 g/m² of gelatin with the following coating aid:

Polymer

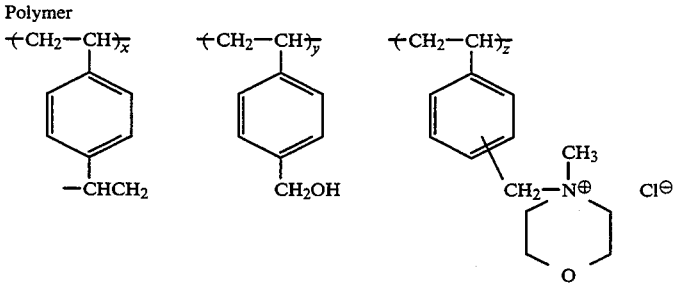

x:y:z = 5:5:90

Coating aid

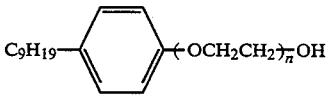

(n = 30);

(5) Protective layer obtained by coating 0.6 g/m² of gelatin.

Among these layers, Layer (1) thus coated was dried at a temperature of 80° C. Similarly, Layers (2), (3), (4) and (5) were dried at temperatures of 90° C., 100° C., 60° C. and 60° C., respectively.

Image-receiving sheet:

A light-sensitive sheet was prepared by coating on a transparent polyethylene terephthalate support the following layers:

Backing layer:

(a) Backing layer containing 4.0 g/m$^2$ of carbon black and 2.0 g/m$^2$ of gelatin Emulsion layer side:

(1) Layer containing 0.44 g/m$^2$ of the following cyan dye-releasing redox compound, 0.09 g/m$^2$ of tricyclohexyl phosphate, 0,008 g/m$^2$ of 2,5-di-t-pentadecylhydroquinone and 0.8 g/m$^2$ of gelatin:

Cyan dye-releasing redox compound

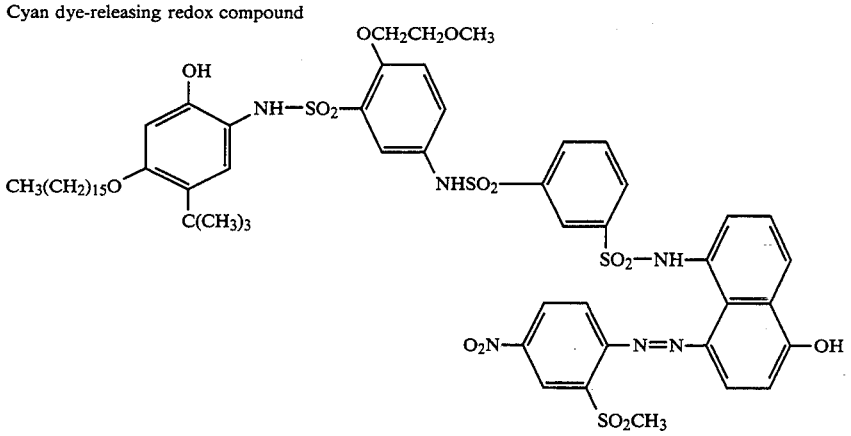

(2) Red-sensitive emulsion layer containing a red-sensitive internal latent image type direct positive silver bromide emulsion (1.03 g/m$^2$ as calculated in terms of silver; gelatin content: 1.2 g/m$^2$), 0.04 mg/m$^2$ of the following nucleating agent and 0.13 g/m$^2$ of sodium salt of 2-sulfo-5-n-pentadecylhydroquinone:

Nucleating agent

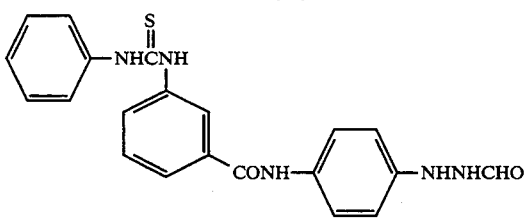

(3) Layer containing 0.43 g/m$^2$ of 2,5-di-t-pentadecylhydroquinone, 0.1 g/m$^2$ of trihexyl phosphate and 0.4 g/m$^2$ of gelatin;

(4) Layer containing 0.21 g/m$^2$ of the following magenta dye- releasing redox compound I, 0.11 g/m$^2$ of the following magenta dye-releasing redox compound II, 0.08 g/m$^2$ of tricyclohexyl phosphate, 0.009 g/m$^2$ of 2,5-di-t-pentadecylhydroquinone and 0.9 g/m$^2$ of gelatin:

Magenta dye-releasing redox compound I

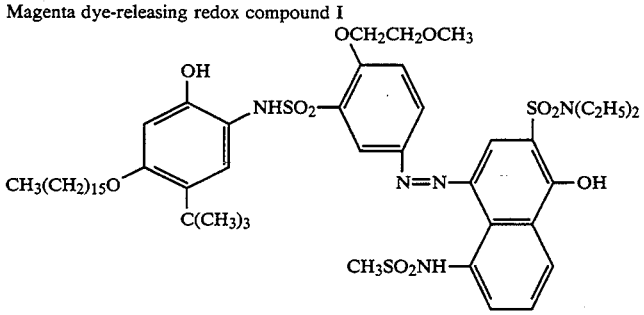

Magenta dye-releasing redox compound II

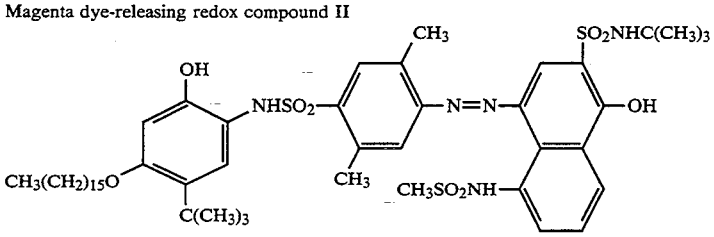

(5) Green-sensitive emulsion layer containing a green-sensitive internal latent type direct positive silver bromide emulsion (0.82 g/m$^2$ as calculated in terms of silver; gelatin content: 0.9 g/m2), 0.03 mg/m$^2$ of the same nucleating agent as used in Layer (2) and 0.08 g/m$^2$ of sodium salt of 2-sulfo-5-n-pentadecylhydroquinone;

(6) The same as Layer (3);

(7) Layer containing 0.53 g/m$^2$ of the following yellow dye-releasing redox compound, 0.13 g/m$^2$ of tricyclohexyl phosphate, 0,014 g/m$^2$ of 2,5-di-t-pentadecylhydroquinone and 0.7 g/m$^2$ of gelatin:

Yellow dye-releasing redox compound

-continued

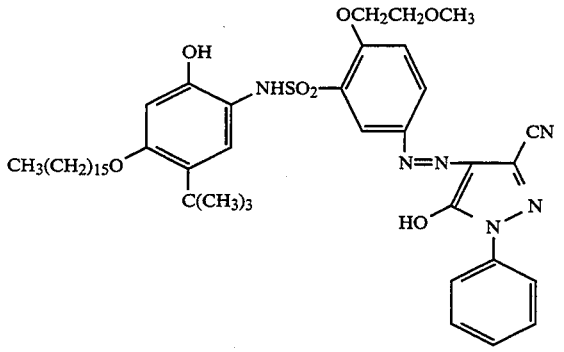

(8) Blue-sensitive emulsion layer containing a blue-sensitive internal latent image type direct positive silver bromide emulsion (1.09 g/m$^2$ as calculated in terms of silver; gelatin content: 1.1 g/m2), 0.04 mg/m$^2$ of the same nucleating agent as used in Layer (2) and 0.07 g/m$^2$ of sodium 2-sulfo-5-n-pentadecylhydroquinone;

(9) Layer containing 1.0 g/m$^2$ of gelatin.

Thus, Image-receiving sheet No. 101 was prepared. Image-receiving sheet Nos. 102 to 105 were prepared as examples according to the present invention in the same manner as No. 101, except that the support was altered to Support Nos. 2 to 5, respectively. Similarly, an image-receiving sheet was prepared as a comparative example in the same manner as No. 101, except that the support was altered to Support No. 6 (Image-receiving sheet No. 106C).

| Processing solution: | |
|---|---|
| 1-p-Tolyl-4-hydroxymethyl-4-methyl-3-pyrazolidone | 8.0 g |
| Methyl hydroquinone | 0.1 g |
| 5-Methylbenzotriazole | 5.0 g |
| Sodium sulfite cellulose | 2.0 g |
| Hydroxyethyl cellulose | 40 g |
| Potassium hydroxide | 56 g |
| Benzyl alcohol | 2.0 g |
| Water to make | 1 kg |

The image-receiving sheets 101 to 105 and 106C thus obtained and the various supports (free of image-receiving sheet) were measured for surface roughness (central line average surface roughness (Ra) was determined by means of a contact feeler type surface roughness analyzer SE-30H (available from Kosaka Kenkyusho K.K.) as described herein). In the measurement, the cutoff value was 0.25 mm. After the foregoing light-sensitive sheet was exposed to light for 0.01 second with 10 CMS at a color temperature of 4,800K, it was then laminated on the various image-receiving sheets in a face-to-face fashion. The foregoing processing solution was then spread between the two sheets to a thickness of 65 μm with the aid of a pressure roller.

The processing was effected at a temperature of 15° C. for 4 minutes. Thereafter, the light-sensitive sheet and the image-receiving sheet were peeled off each other.

The results of Ra and image unevenness (visual evaluation) are set forth in Table 2.

TABLE 2

| Support No. | Image-receiving sheet No. | Image unevenness | Ra value (μm) Image-receiving sheet | Ra value (μm) Support alone | Remarks |
|---|---|---|---|---|---|
| 1 | 101 | Good | 0.022 | 0.020 | Invention |
| 2 | 102 | Good | 0.025 | 0.022 | Invention |
| 3 | 103 | Good | 0.020 | 0.015 | Invention |
| 4 | 104 | Good | 0.021 | 0.018 | Invention |
| 5 | 105 | Good | 0.025 | 0.023 | Invention |
| 6 | 106C | Poor | 0.176 | 0.105 | Comparison |

As is apparent from Table 2, the comparative example exhibits a worsened surface roughness due to the coating of an image-receiving sheet while the examples according to the present invention exhibit less surface roughness and image unevenness, proving that the present invention has a great effect.

EXAMPLE 2

1. Preparation of image-receiving sheet:

Image-receiving sheet No. 201 was prepared by coating the following layers on Support No. 1. The figure in parentheses indicate the coated amount (g/m$^2$) unless otherwise indicated. The layers thus coated were dried at a temperature of 90° C.

(1) Neutralizing layer

Methyl vinyl ether-maleic anhydride copolymer (4), cellulose acetate (percent acetylation: 55%) (6), Uvitex OB (trade name of a product available from Ciba Geigy Co., Ltd.) (0.01), 1-(4-hexylcarbamoylphenyl)-2,3-dihydroxyimidazole-2-thione (0.05).

(2) Image-stabilizing layer

Cellulose acetate (percent acetylation: 46%) (4), the following polymer A (2):

Polymer A

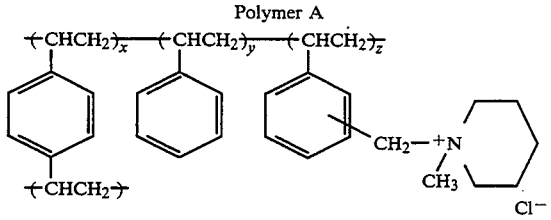

x:y:z = 5:47.5:47.5

(3) Timing layer

Cellulose acetate (percent acetylation: 55%) (18.5), methyl vinyl ether-maleic anhydride copolymer (0.2), 1-(4-hexylcarbamoylphenyl)-2,3-dihydroxyimidazole-2-thione (0.1).

(4) Image-receiving layer

Cellulose acetate (percent acetylation: 55%) (1.5), palladium sulfate ($9.5\times10^{-4}$), 1-(4-hexylcarbamoylphenyl)-2,3-dihydroimidazole-2-thione (0.02).

(5) Saponification

Saponification was effected on the surface of the image-receiving layer with a solution obtained by mixing 12 g of sodium hydroxide, 24 g of glycerin and 280 ml of methanol. The saponified surface was then washed with water.

(6) Peelable layer

15:85 (molar ratio) butyl methacrylate-acrylic acid copolymer (0.05).

(7) Backing layer

The other side of the foregoing support was coated with a light shielding layer, a white layer and a protective layer.

(7-1) Light shielding layer

Carbon black (4), gelatin (8), spherical grains of polyacrylate (average diameter: 0.05 μm) (0.2).

(7-2) White layer

Titanium dioxide (6), gelatin (0.7).

(7-3) Protective layer

Polymethyl methacrylate (average diameter: 0.05 μm) (0.2), gelatin (1.6).

Further, image-receiving sheet Nos. 202 to 205 were prepared as examples according to the present invention in the same manner as No. 201 except that the support was altered to Support Nos. 2 to 5, respectively. Similarly, Image-receiving sheet No. 206C was prepared as a comparative example in the same manner as No. 201, except that the support was altered to Support No. 6.

2. Preparation of light-sensitive element:

A light-sensitive element was prepared by coating the following layers on a support (polyethylene terephthalate). The figure in parentheses indicate the coated amount in g/m$^2$ unless otherwise indicated.

(1) Light-sensitive layer

Silver bromoiodide (AgI content: 3.0% by mole) having an average grain diameter of 1.8 μm and an aspect ratio of 5.0 (0.60 as calculated in terms of silver),4-hydroxy-6-methyl-l,3,3a,7-tetrazaindene (0.012), the following sensitizing dye A ($4.1\times10^{-4}$), the following sensitizing dye B ($4.1\times10^{-4}$), the following sensitizing dye C ($1.4\times10^{-4}$), gelatin (3.6):

Sensitizing dye A

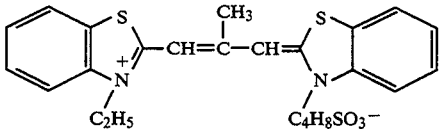

Sensitizing dye B

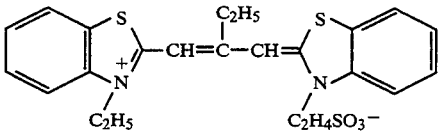

Sensitizing dye C

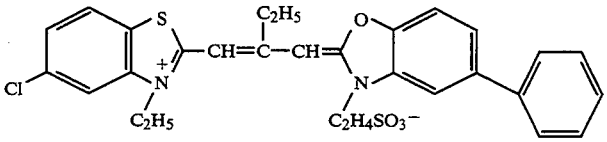

(2) Protective layer

Gelatin (0.7), polymethyl methacrylate grains (average diameter: 4.7 μm) (0.1).

(3) Backing layer (3-1) Light shielding layer

Carbon black (4.0), gelatin (2.0).

(3-2) Protective layer

Gelatin (0.7), polymethyl methacrylate grains (average diameter: 0.05 μm) (0.1).

3. Preparation of processing element:

The following processing solution was prepared in a stream of nitrogen. The processing solution thus prepared was then packed into rupturable vessels (pod) in an amount of 0.7 g for each.

| Composition | Added Amount |
|---|---|
| Titanium dioxide | 5 g |
| Potassim hydroxide | 280 g |
| Uracil | 90 g |
| Tetrahydropyrimidinethione | 0.2 g |
| 1-Phenyl-2-mercaptoimidazole | 0.2 g |
| Zinc nitrate $9H_2O$ | 40 g |
| Triethanolamine | 6 g |
| 60% aqueous solution of 1-hydroxyethylidene-1,1-diphosphate | 15 g |
| Hydroxyethyl cellulose | 45 g |
| Potassium iodide | 1 g |
| 17% aqueous solution of N,N-bis (methoxyethyl)hydroxylamine | 220 g |
| 4-Methyl-4-hydroxymethyl-1-phenyl-3-pyrazolidone | 10 g |
| Water | 1,300 ml |

4. Spreading:

The light-sensitive sheet thus prepared was exposed to light from a light source having a color temperature of 4,800K in a sensitometer for 0.01 seconds. In specimens obtained by combining Image-receiving sheet Nos. 201 to 205 and 206C with the foregoing processing solution, the processing solution was spread to a thickness of 37 μm at a temperature of 25° C. After 15 seconds, the two sheets were peeled off each other to provide a transfer image on the image-receiving sheet. The results of Ra and image unevenness are set forth in Table 3.

TABLE 3

| Support No. | Image-receiving sheet No. | Image unevenness | Ra value (μm) Image-receiving sheet | Ra value (μm) Support alone | Remarks |
|---|---|---|---|---|---|
| 1 | 201 | Good | 0.022 | 0.020 | Invention |
| 2 | 202 | Good | 0.024 | 0.022 | Invention |
| 3 | 203 | Good | 0.019 | 0.015 | Invention |
| 4 | 204 | Good | 0.022 | 0.018 | Invention |
| 5 | 205 | Good | 0.026 | 0.023 | Invention |
| 6 | 206C | Poor | 0.158 | 0.105 | Comparison |

As is apparent from Table 3, the present invention has a great effect.

EXAMPLE 3

Specimens were prepared in the same manner as Nos. and 106C except that the drying temperature of Layers (1) and (2) and Layer (3) were altered to 100° C., 100° C. and 115° C., respectively. These specimens were then developed. As a result, the specimen comprising No. 106C exhibited a slightly turbid image with a low maximum density, proving that the present invention has a great effect. Further, the specimen obtained by drying Layer (1) at a temperature of 100° C. in No. 106C exhibited a detectable crater-like unevenness on a part of the surface. In this respect, too, the superiority of the present invention over the comparative example in heat resistance can be definitely proved.

EXAMPLE 4

The following components were coated on Support No. 101 in the order described.

Back layer side:

The same as Image-receiving sheet No. 101.

Light-sensitive material side:

Layers I to IV: the same as Layers (1) to (4) in Image-receiving sheet No. 101;

Layer V: hydroxyethyl cellulose (SP600 available from Daicel Chemical Industries, Ltd.) (4 g/m$^2$);

Layers VI to XIV: the same as the light-sensitive sheets (1) to (9) in Example 1.

Processing solution:

The same composition as the processing solution used in Example 1 except that a carbon black dispersion (Colombian Carbon R420) was added thereto in an amount of 150 g (as calculated in terms of carbon black)

The foregoing processing solution was spread between the light-sensitive material and a 100-μm transparent polyester base to a thickness of 65 μm with the aid of a pressure roller. The processing was effected at a temperature of 25° C. After 1 hour, the light-sensitive material was peeled off the base.

The comparative material was prepared and processed in the same manner as the above-described material according to the present invention, except that the support was replaced with Support No. 106C.

The material comprising Support No. 101 exhibit less image unevenness (visual evaluation) than the comparative material comprising Support No. 106C.

In accordance with the constitution of the present invention, a product of diffusion transfer photography can be obtained which exerts a remarkable effect of improving image unevenness and sharpness and an excellent heat resistance during preparation.

While the invention has been described in detail and with reference to specific embodiments thereof, it will be apparent to one skilled in the art that various changes and modifications can be made therein without departing from the spirit and scope thereof.

What is claimed is:

1. A product of diffusion transfer photography comprising (a) a light-sensitive element having at least a silver halide emulsion layer, (b) an image-receiving element having an image-receiving layer, (c) two supports, and (d) a processing element having an alkaline processing solution developed between the two supports, wherein one of the two supports is a reflective support coated with (a) a composition obtained by mixing and dispersing a white pigment in a polyester synthesized by polycondensation of a dicarboxylic acid with a diol on at least the surface of the support on which the image-receiving layer is to be coated, wherein the dicarboxylic acid component is a 9:1 to 2:8 mixture by mole of terephthalic acid to naphthalenedicarboxylic acid, and (b) a resin or a resin composition obtained by mixing and dispersing a powder in the resin on the other surface of the support;

and wherein the elements and the supports are arranged so that (a) the image-receiving element and the light-sensitive element are coated on separate supports, (b) the surface of the light-sensitive element and the surface of the image-receiving element are kept separated from each other before exposure and brought into contact with each other during development after exposure, and (c) the image-receiving element is separated from the light-sensitive element after the formation of an image to make the image visible from the image-receiving layer side of the reflective support.

2. The product of diffusion transfer photography as claimed in claim 1, wherein the polyester to be incorporated in the reflective support is polyester comprising polyethylene terephthalate as a main component.

3. The product of diffusion transfer photography as claimed in claim 1, wherein the diol is ethylene glycol.

4. The product of diffusion transfer photography as claimed in claim 1, wherein the white pigment to be incorporated in the reflective support is titanium oxide and the weight proportion of titanium oxide to polyester is from 5/95 to 50/50.

5. The product of diffusion transfer photography as claimed in claim 1, which has been subjected to at least one drying procedure at a temperature of 80° C. or higher in coating the image-receiving layer or the image-receiving element.

* * * * *